US005218719A

United States Patent [19]

Johnson

[11] Patent Number: 5,218,719

[45] Date of Patent: Jun. 15, 1993

[54] BATTING GLOVE

[76] Inventor: Glenn R. Johnson, 4118 C Liberty Ct., Kokomo, Ind. 46902

[21] Appl. No.: 841,236

[22] Filed: Feb. 24, 1992

Related U.S. Application Data

[63] Continuation of Ser. No. 474,518, Feb. 2, 1990, abandoned.

[51] Int. Cl.[5] ..... A41D 19/00

[52] U.S. Cl. ..... 2/19; 2/20; 2/161 A

[58] Field of Search ..... 2/19, 20, 16, 17, 161 A, 2/160, 161 R, 159

[56] References Cited

U.S. PATENT DOCUMENTS

| | | | |
|---|---|---|---|
| 1,479,771 | 1/1924 | Campbell | 2/16 |
| 1,486,006 | 3/1924 | Blom . | |
| 2,093,648 | 6/1937 | Arnold | 2/161 R |
| 2,465,136 | 3/1949 | Troccoli | 2/159 |
| 2,710,970 | 6/1955 | Kennedy | 2/159 |
| 3,255,462 | 6/1966 | Antonious | 2/161 A |
| 3,863,271 | 2/1975 | Moroney | 2/161 A |
| 3,922,724 | 12/1975 | Shockovsky | 2/161 A |
| 4,042,975 | 8/1977 | Elliott, Jr. et al. | 2/19 |
| 4,071,913 | 2/1978 | Rector . | |
| 4,131,952 | 1/1979 | Brenning, Jr. . | |
| 4,187,557 | 2/1980 | Tombari . | |
| 4,272,849 | 6/1981 | Thurston et al. . | |
| 4,329,741 | 5/1982 | Bach . | |
| 4,546,495 | 10/1985 | Castillo . | |
| 4,561,122 | 12/1985 | Stanley et al. . | |
| 4,590,625 | 5/1986 | Keim . | |
| 4,691,387 | 9/1987 | Lopez . | |
| 4,700,405 | 10/1987 | Sternberg . | |
| 4,733,412 | 3/1988 | Campbell . | |
| 4,748,690 | 6/1988 | Webster | 2/20 X |
| 4,793,005 | 12/1988 | Hetzel, Jr. | 2/161 A |

*Primary Examiner*—Clifford D. Crowder
*Assistant Examiner*—Sara M. Current
*Attorney, Agent, or Firm*—Woodard, Emhardt, Naughton Moriarty & McNett

[57] ABSTRACT

A batting glove for use in softball, baseball, or other games of the like wherein a wooden or metallic bat is used. The batting glove includes pads located between the first and second phalangeal joints and a palm pad located across the metacarpophalangeal joints of the hand in order to create a reminder groove or slot and encourage a proper grip of the bat by the batter. The glove also includes means for securing the glove to the wrist of the wearer such as velcro fasteners and the like. In addition, elastic materials sewn into or attached to the wrist area of the glove may also provide means for securing the glove around the wrist of the wearer.

An alternate embodiment of the batting glove includes fluid filled compartments incorporated into certain areas of the palm side of the glove. The fluid compartments may be permanently filled and sealed with air, liquid, putty, or a gel. An air pressure supply device, or air bladder, is incorporated into the glove for supplying pressurized air to the fluid compartments. A relief valve is also included to release pressurized air from the fluid compartments.

7 Claims, 7 Drawing Sheets

BATTING GLOVE

This application is a continuation of application Ser. No. 07/474,518, filed Feb. 2, 1990, now abandoned.

BACKGROUND OF THE INVENTION

1. Field of the Invention

This invention relates in general to athletic aids and equipment and more specifically to a batting glove including features to encourage proper batting techniques.

Baseball and softball are popular sports enjoyed by many. Over the years a great investment of energy and time has been expended to teach those unfamiliar with baseball or softball the proper technique for swinging a bat. Specifically, it is well known that a correct swing path for the bat follows a level path with respect to the ground, or a slightly downward path. It is well documented that such a swing path produces a line-drive hit or trajectory of the baseball or softball. It is also well known that 70–75 percent of all line-drive hits result in "base" hits.

In contrast, a swing which follows an upward path is more likely to produce a pop-up or fly ball. Eighty-five percent of all pop-ups or fly balls are caught for outs by the defensive fielders of the opposing team. Thus, it would appear that unless one is highly successful in hitting pop-ups or fly balls over the home run fence, it is best to develop the level or downward path swing to produce the line drive type hits.

The relative position or placement of the bat in the hitter's hands is one of the most critical elements for achieving a proper swing. Most inexperienced hitters and improperly instructed hitters will tend to hold the handle of the bat in the palm of their hands nestled in the yoke area of the thumbs. By positioning the bat and handle in the palm of the hands, a batter greatly increases the likelihood that an improper swing will occur. The improper swing results from the action of the hands in conjunction with each other in moving the bat handle from a substantially vertical position near the side of the body at approximately shoulder height to a horizontal position in front of the body to make contact with a pitched ball. During the movement of the bat or the swing, several significant timing relationships between the bat and the hitter's wrists, fingers and hands will occur. Positioning the bat handle in the palm of the hands prevents rolling of the wrists during the swing. Without proper wrist position during the swing, the arms and hands do not fully transfer the hitter's strength thus significantly reducing the power imparted to the ball as well as producing an upward swing. Both of these conditions result in pop-ups, or weak ground balls which are typically fielded for outs.

A batting glove including certain structures designed to encourage a proper grip of the bat handle in the fingers of the hand rather than in the palm of the hand is needed to encourage proper bat gripping and swinging techniques. A proper grip and swing improves the batter's hitting percentage by increasing the number of line-drives as opposed to pop-ups, fly balls and weak ground balls.

SUMMARY OF THE INVENTION

In accordance with one aspect of the invention, a batting glove according to the present invention comprises a glove having a palmar surface, a dorsal surface, a plurality of finger portions and a thumb portion, a plurality of finger pads attached to the glove on the palmar surface between a first and second phalangeal joint area of each finger portion of the glove, and a palm pad attached to the palmar surface of the glove and extending at least over the metacarpophalangeal joint areas of the palmar surface.

In accordance with another aspect of the invention, a batting glove according to the present invention comprises a batting glove having a palmar surface, a dorsal surface, a plurality of finger receiving portions and a thumb receiving portion, and means for locating a bat over the first phalangeal bone area including palm means attached to the palmar surface over the metacarpophalangeal joint area for encouraging a bat handle into the area adjacent the first phalangeal bone of each finger and finger means attached adjacent the palmar side of a second phalangeal bone of at least one finger for encouraging a bat handle into an area adjacent the palm side of the first phalangeal bone of each finger.

In accordance with yet another aspect of the invention, a batting glove according to the present invention comprises a batting glove having a palmar surface, a dorsal surface, a plurality of finger receiving portions and a thumb receiving portion, at least one fluid filled finger pad compartment located adjacent the palmar side of a second phalangeal bone, the fluid filled compartment attached to the glove in the area adjacent the second phalangeal bone, a fluid filled palm pad compartment attached adjacent the metacarpophalangeal area of the palmar surface of the glove, the palm pad compartment protruding from and covering at least one metacarpophalangeal joint area on the palmar surface of the glove.

It is an object of the present invention to provide an improved batting glove.

Another object of the present invention is to provide an apparatus for teaching a proper batting swing.

Another object of the present invention is to provide a batting glove which includes structures for encouraging a batter to grip the handle of the bat in the fingers rather than in the palm of the hand.

It is yet another object of the present invention to provide additional reinforcement in certain areas of a batting glove which typically wear out or wear through more quickly than the remainder of the glove.

These and other objects of the present invention will become more apparent from the following description of the preferred embodiment.

DESCRIPTION OF THE PREFERRED EMBODIMENT

Figure 1:
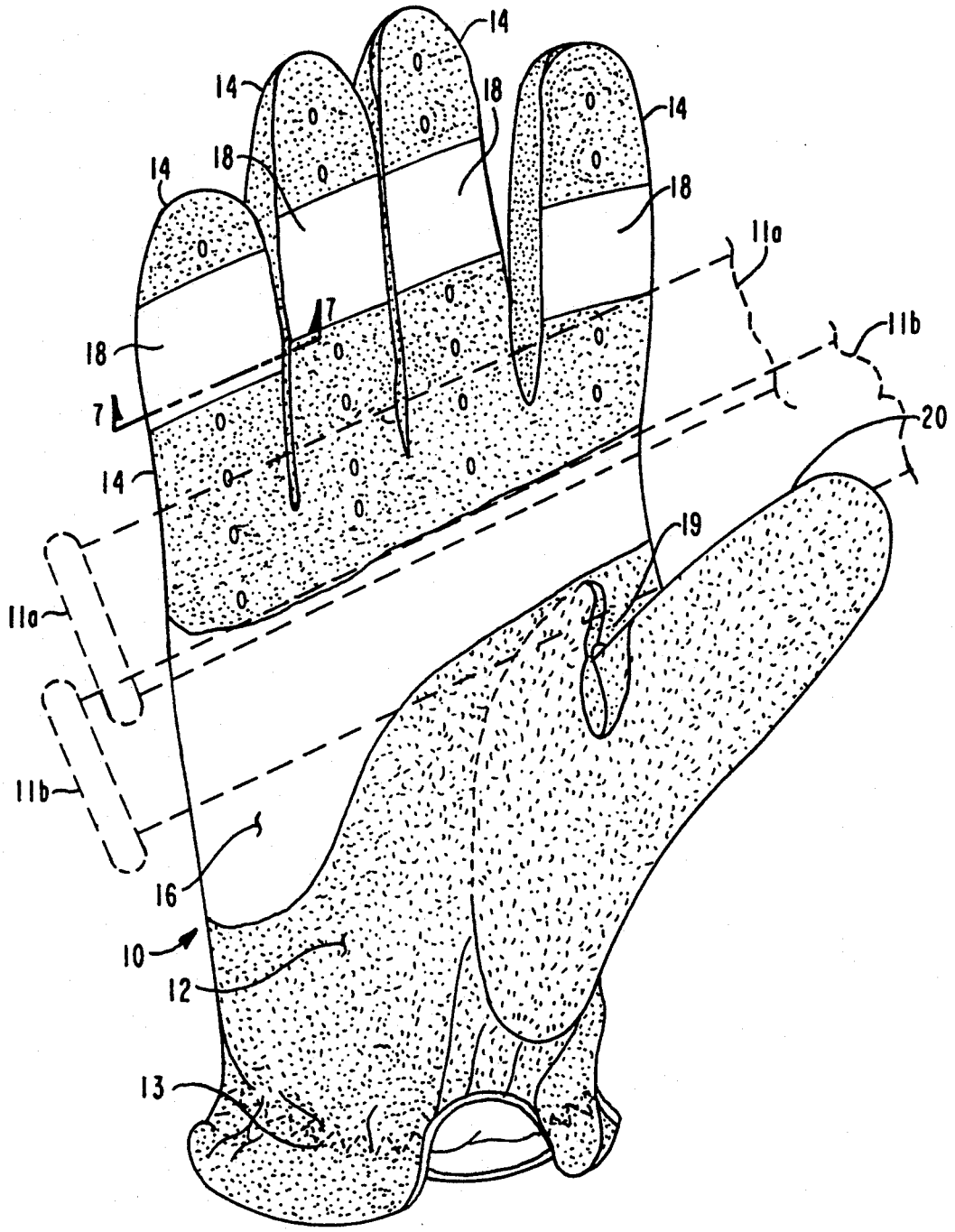
FIG. 1 is a palmar side view of the batting glove according to the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, an improved batting glove 10 according to the present invention is shown. The improved batting glove 10 includes typical components of a softball or baseball batting glove. The typical components of a batting glove are an elastic wristband 13, palm portion 12, a thumb portion 20, finger portions 14 and a dorsal portion (not shown). In addition to the components of a standard batting glove, the improved batting glove according to the present invention includes palm pad 16 and finger pads 18. Various alternate means for securing a batting glove to a wearer's hand are known in the art. Such alternatives include Velcro fastener straps, buckles and the like, and are contemplated as substitutes for elastic wristband 13.

All components of the batting glove 10 are made from leather (from the hides of animals) and sewn together with the exception of the wristband 13. In the alternative, certain man-made synthetic compounds having characteristics similar to leather may be substituted for the component parts of the improved batting glove 10. Pads 16 and 18 may be sewn or glued in place in the indicated locations of FIG. 1.

Resilient foam rubber padding or suitable substitutes are contemplated as an additional component of the improved batting glove 10. The padding, in flat sheet form, is cut or trimmed to correspond in size with pads 16 and 18. The padding is situated on or glued to the glove-side of the pads 16 and 18 prior to their attachment to glove 10. The foam padding, shown in more detail in FIG. 7, raises the height of pads 16 and 18 above the remainder of the glove having unpadded areas. Increased surface height of pads 16 and 18 further accentuates the bat handle slot defined by pads 16 and 18 to improve the result on the batter's grip of the bat 11, i.e. teach and encourage a proper grip.

A baseball or softball bat 11A, indicated by a broken line, is shown properly positioned with respect to the palm area 12 and the finger portions 14 of the glove 10. In order for a batter to hold the bat 11A properly, the bat should be positioned as shown with respect to the palm, fingers and thumb prior to the batter closing his hand about bat 11A to grip the bat handle.

Figure 2:
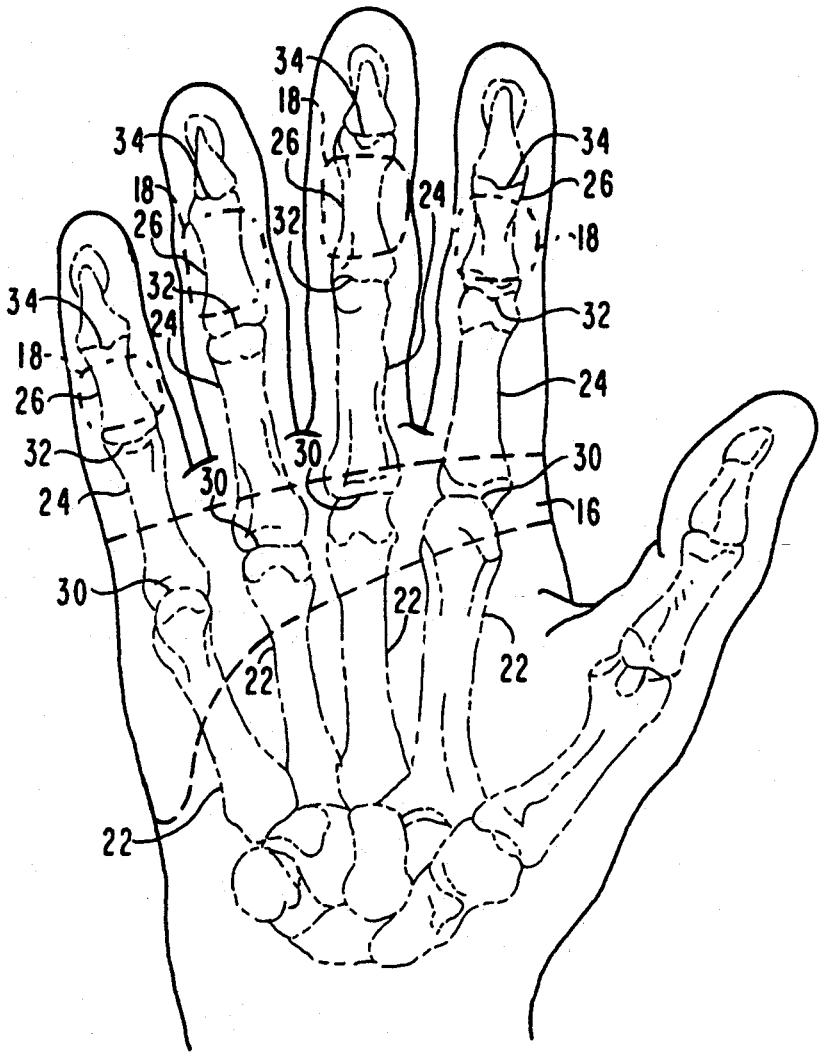
FIG. 2 is a palmar view of the bones of the hand showing the relative location of the palm pad and finger pads with respect to the bones and related joints of the hand.

Referring now to FIG. 2, the positioning of the finger pads 18 and the palm pad 16 (both shown as broken lines) of the batting glove 10 shown in FIG. 1 is more specifically revealed with respect to the bones and joints of the hand. Palm pad 16 is positioned over the metacarpophalangeal joint areas 30. The metacarpophalangeal joint is found between the metacarpal bones 22 of the palm and the first phalangeal bones 24 of each finger. The finger pads are positioned between the first and second phalangeal joints 32 and 34, respectively, or substantially covering the area over the second phalangeal bone 26 of each finger of the hand. From the description of the location of the pads 18 and 16 with respect to the bones of the hand, it becomes apparent that when the bat 11A, shown in FIG. 1, is gripped in the hand, the first phalangeal bones 24 are intended to span a side of the cylindrical bat handle. As the fingers are clinched about the bat handle, the pads 18 grasp one side of the bat handle, and the palm pad 16 is positioned approximately opposite diametrically from the finger pads 18. Pads 18 and 16 together form a bat grip positioning reminder to encourage the batter to position the bat handle along the first phalangeal bones 24 and thereby develop proper bat gripping techniques which thereby promote a desired level or downward swing.

Proper versus improper gripping of the bat is further emphasized by comparing the positioning of bat 11A versus bat 11B in FIG. 1. An undesirable palm grip wherein the bat resides fully in the palm or nested in the yoke 19 between the thumb and the palm of the hand is exemplified by the positioning of bat 11B in FIG. 1. When the bat is fully gripped in the position of bat 11B, a palm grip will result and the power transfer and coordination of the hands and arms developed throughout a swing will be influenced and altered by the incorrect grip. In particular, a palm grip will encourage an upward swing with reduced power and thereby result in a higher likelihood of a fly-out or a pop-fly. By positioning the bat in a position shown by bat 11A, finger-tip control of the bat is enhanced, and the rolling of the hands with respect to the arms as the bat is swung around the body will take place in a more comfortable manner from the viewpoint of the batter such that a downward or level swing is more easily produced by the batter.

Figure 3:
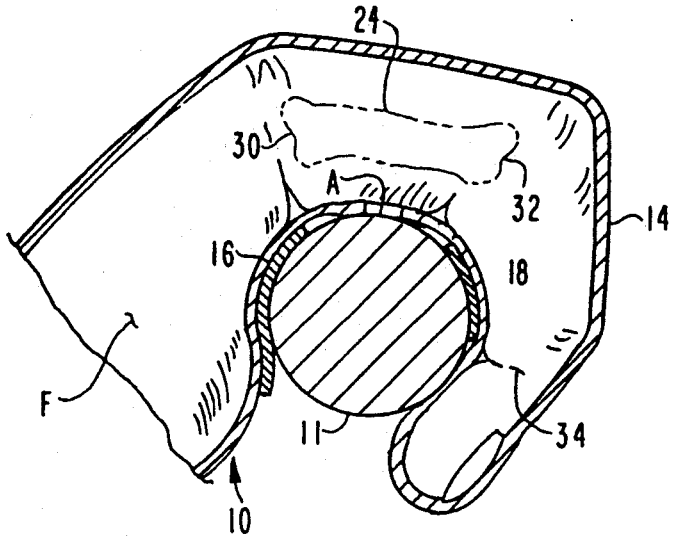
FIG. 3 is a sectional view along the centerline of a bat showing the finger portion of the batting glove according to the present invention and a finger within the glove wrapped about a bat handle.

Referring now to FIG. 3, a cutaway view of a finger portion 14 of the improved batting glove 10 looking in the direction of the center line of the bat is shown. FIG. 3 illustrates a typical finger of the hand gripping a bat handle, however as the fingers of the hand vary in length it should be understood that the relative locations of the fingers and joints shown shall vary slightly from finger to finger. Depicted in the cutaway view is finger portion 14 covering a finger F. The relative location of the metacarpophalangeal joint 30 and the first and second phalangeal joints 32 and 34, respectively, provides locating references with respect to FIG. 2 in defining the location of finger pad 18 and palm pad 16. As the finger F tightens a grip about the bat 11, the bat 11 is encouraged toward location A, a slot adjacent the first phalangeal bone 24 and defined by and between finger pad 18 and palm pad 16.

Pads 16 and 18 are constructed of leather in one embodiment, but may also be made of "tacky" materials such as rubber or synthetic rubber in order to provide increased frictional gripping strength between pads 16 and 18 and the handle of the bat 11. The reminder grip or slot defined by pads 18 and 16 encourages the batter to continually adjust the bat so that the bat 11 resides within the slot or groove defined between pads 18 and 16 at location A. Location A is essentially the palmar side surface of each finger between the metacarpophalangeal joint 30 and the first phalangeal joint 32 adjacent the second phalangeal bone 26.

Figure 4:
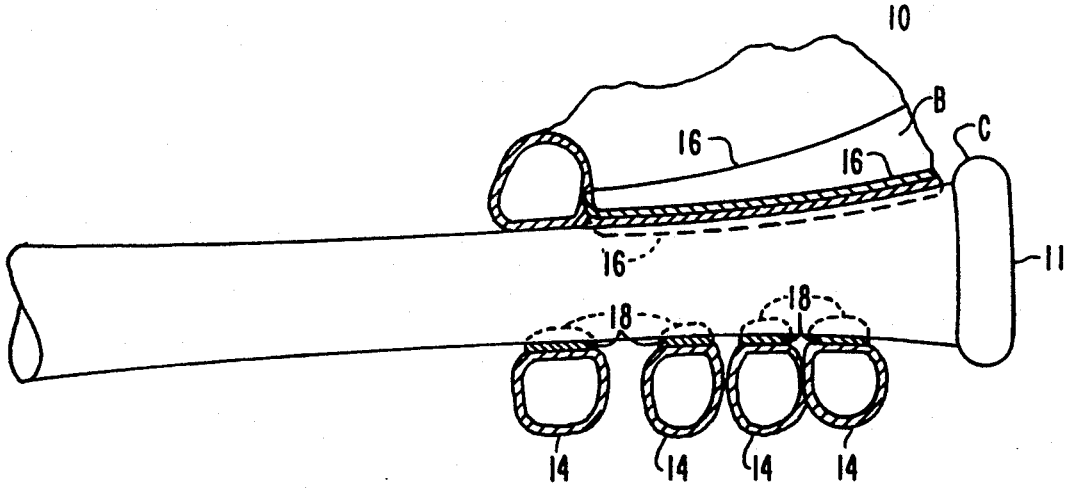
FIG. 4 is a longitudinal sectional view of a right hand within the batting glove 10 gripping the handle of a bat.

Referring now to FIG. 4, a cross-sectional view along the centerline of bat 11 through the second phalangeal bone areas of the improved batting glove 10 is shown. Finger pads 18, attached to finger portions 14, are shown positioned approximately diametrically opposing palm pad 16.

Location B of palm pad 16 oftentimes contacts the butt end of bat 11 at location C during a typical swing of bat 11. Palm pad 16 provides added protection against wear through at location B. Wear through occurs at location B most commonly with the gloves of the prior art as a result of the knob at the butt, end of bat 11 in the area of location C rubbing against the glove and wearing a hole through the glove material. The increased protection against wear through provided by palm pad 16 in conjunction with the locating and positioning effect from palm pad 16 and finger pads 18 encouraging the bat 11 into the proper location within the fingers provides for an improved and superior glove as compared to those of the prior art.

Figure 5B:
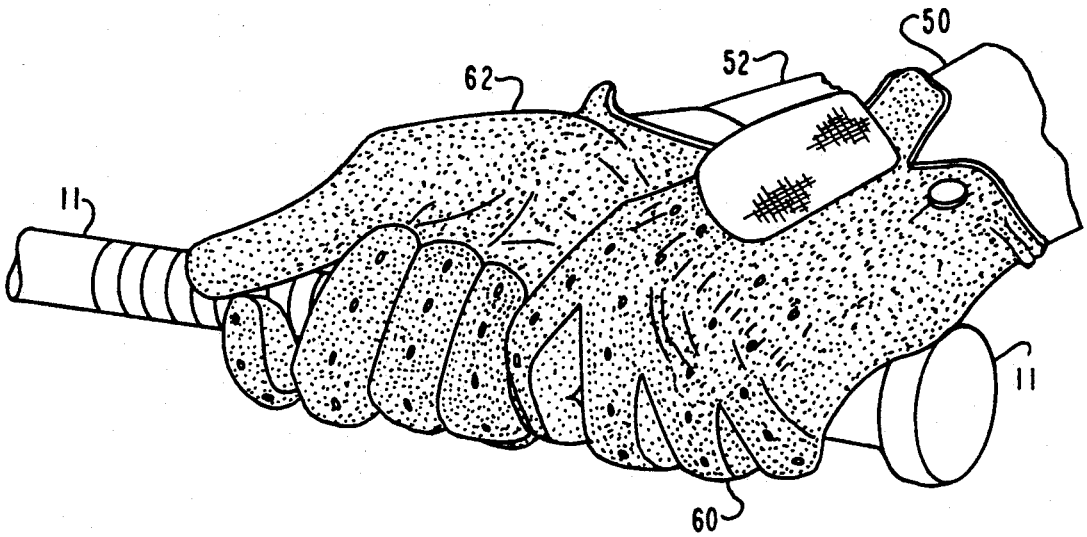
FIG. 5B is a front view of a properly gripped bat just prior to impact with a delivered pitch illustrating proper hand and wrist positioning during a swing.
Figure 5A:
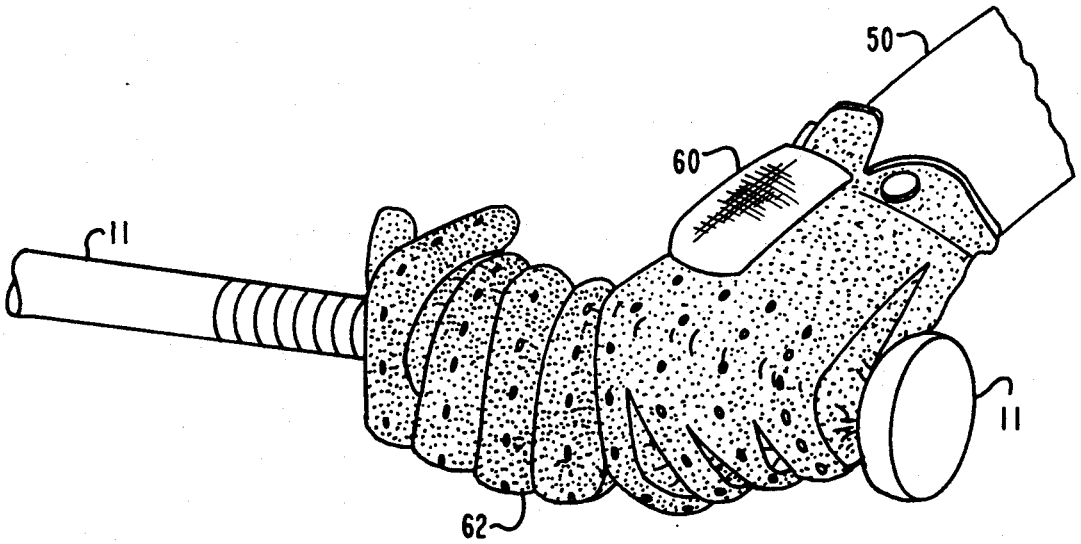
FIG. 5A is a front view of an improperly gripped bat just prior to impact illustrating awkward hand and wrist positioning.
Figure 6B:
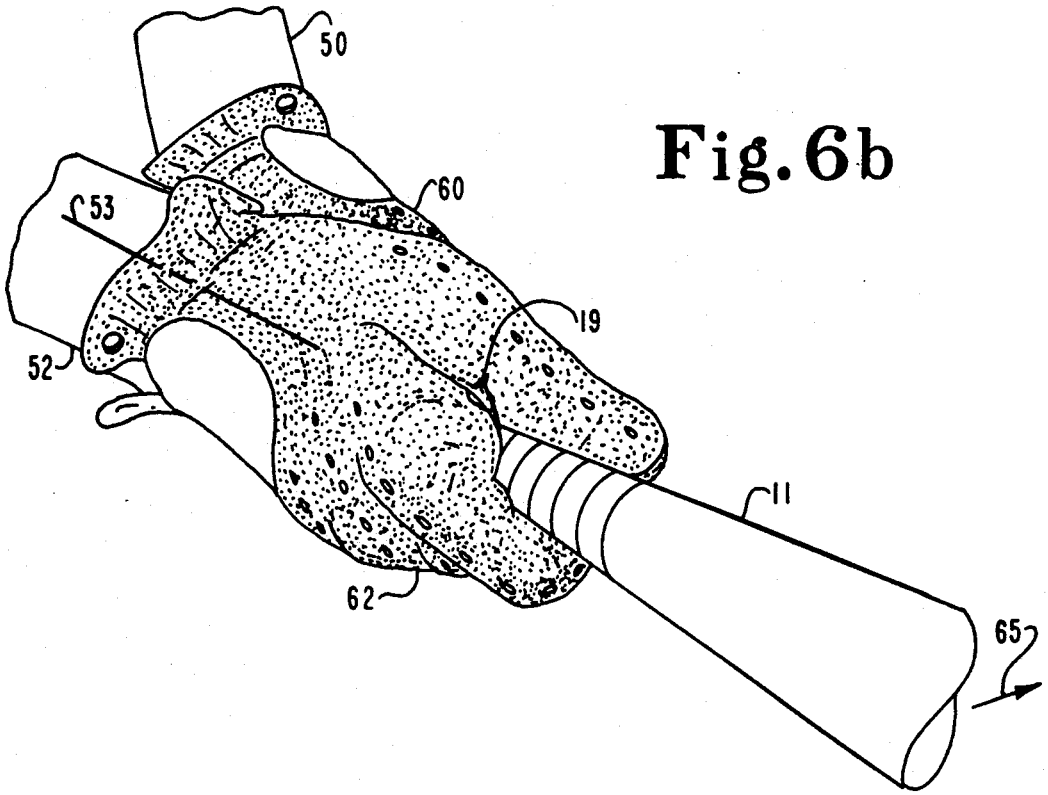
FIG. 6B is a rear view of a properly gripped bat depicting the position of the wrists at or near the point of impact with a delivered pitch.
Figure 6A:
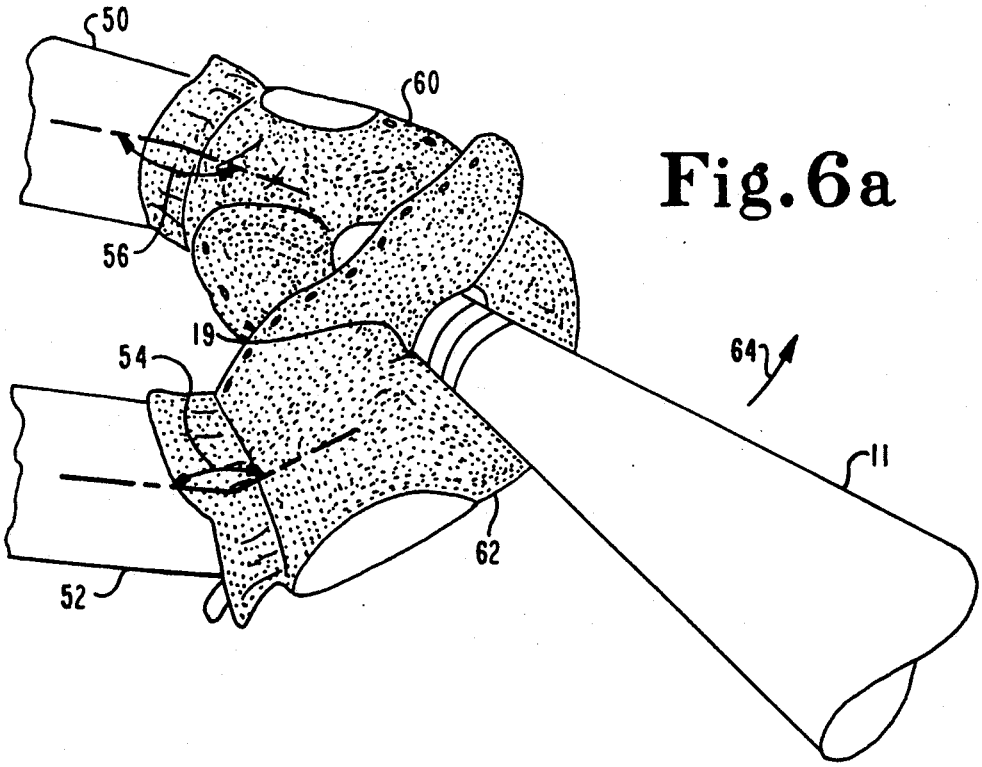
FIG. 6A is a rear view of an improperly gripped bat illustrating the resulting awkward angular relationships between the hands and wrist attributable to an improper grip.

Referring now to FIGS. 5A and 6A, a front and rear view of an improperly gripped bat illustrating the resulting angular relationships between the hands and wrists attributable to an improper grip are shown. FIGS. 5A and 6A correspond to the position of the hands upon the bat 11 at or near the point of impact of the bat 11 with a pitched ball (not shown). The angular relationships 54 and 56 describe the relative position of the hands 60 and 62 in relation to the forearms 50 and 52. The angles 54 and 56 represent wrist force angles for transmission of power and speed to the bat 11. With the position of forearm 52 and hand 62, the wrist of the batter is underneath or below the horizontal plane of the bat 11, thereby preventing hand 62 from "rolling over" hand 60 for a proper swing to develop maximum bat velocity. One explanation for failure of wrist rolling is attributable to the bat 11 being snuggled up tightly into the yoke 19 of the hands 60 and 62. A batter tends to swing the bat along the direction of arrow 64 as a result of the improper grip of the bat 11. As is easily seen, the direction of arrow 64 is an upward path substantially parallel to the inclination angle between the forearm 52 and hand 62 as shown in FIG. 6A.

Referring now to FIGS. 5B and 6B, a proper grip of the bat 11 is shown from a front and rear view in substantially a horizontal perspective. As is evident from the positioning of the hands 62 and 60, hand 62 will roll over the top of bat 11 towards hand 60 as the swing progresses in the direction of arrow 65. In addition, the angular relationship between forearm 52 and hand 62 is substantially linear, as indicated by line 53, thereby encouraging hand 62 to roll over the top of bat 11, which in turn creates a maximum velocity for the bat 11 during the "wrist snap" motion of the wrists. A maximum velocity developed with bat 11 provides for increased power transmitted to the pitched ball. The leading arm 50 and hand 60 are encouraged to work in conjunction with forearm 52 and hand 62 during the rolling of the wrist process at or near the impact of the bat 11 with the pitched ball. The action of the wrists rolling is the period in time when the arms and wrists impart a maximum velocity to the bat 11. In addition, the angular relationship of forearm 52 and wrist 62 provide further evidence that hand 62 is in position to roll over the topside of bat 11, and encourage a level or downward swing path of bat 11 at or near the impact area of the bat 11 striking a pitched ball.

The batting glove according to the present invention cannot prevent an improper swing, but does remind a batter to hold the bat properly thereby promoting a proper forearm-wrist-hand relationship, and encouraging the batter to swing a bat properly. The results of a proper swing are statistically proven and irrefutable.

An alternate embodiment for the batting glove 10 according to the present invention may include finger pads on only the first and fourth finger, on the second and third finger only, and any other combination of one, two, or three finger pads as a variation naturally contemplated given the elements of the improved batting glove according to the present invention.

Figure 7:
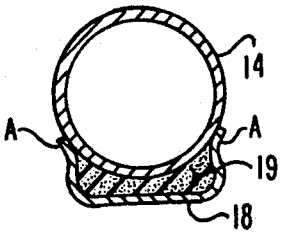
FIG. 7 is a sectional view in the direction of the arrows labelled 7 of FIG. 1 showing padding or a compartment between finger pad 18 and finger portion 14 of glove 10.

Referring now to FIG. 7, a cross-sectional view of a finger portion 14 of batting glove 10 is shown. A cross-section is taken through the central area of the second phalangeal bone to illustrate the cross-section of the finger pad 18. The details of FIG. 7 showing resilient foam padding 19 situated between finger pad 18 and the finger portion 14 illustrate the location or placement of resilient foam padding 19 situated between the finger pad 18 and the finger portion 14 in order to increase the distance that the finger pad 18 protrudes away from the finger portion 14 of glove 10. Pad 18 is attached to finger portion 14 at location A via glue or stitching. Materials well known in the art for resilient padding such as resilient sponge rubber may be used for foam padding 19. Variable degrees of stiffness of the resilient foam padding 19 provide variations in the "feel" of glove 10.

Alternatively, the height building layer 19 is an additional layer or layers of leather or suitable substitute used to raise the finger pad 18 above the surface of finger portion 14.

Figure 8:
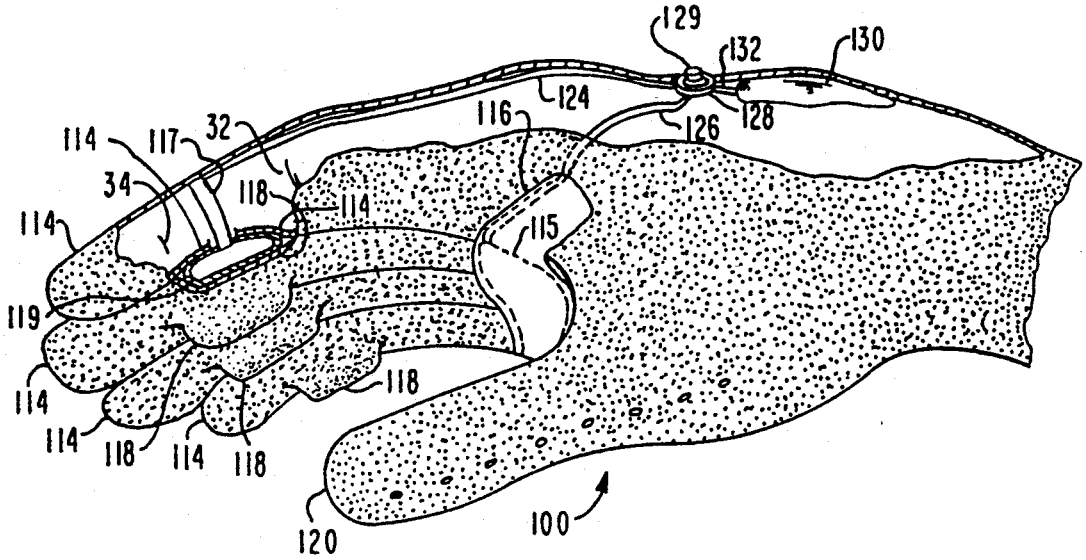
FIG. 8 is a side view of a batting glove according to another aspect of the present invention.

Referring now to FIG. 8, an alternate embodiment of the batting glove 100 according to the present invention is shown. In this embodiment of the improved batting glove 100 according to the present invention, the finger pads 118 and the palm pad 116 are raised above the surface of the standard glove by a fluid filled compartment 119 as shown in the cutaway view of the glove 100. The finger pads 118 and finger fluid compartments 119 correspond in location and surface area to pads 18 of glove 10 and are located between phalangeal joints 32 and 34, respectively. Similarly palm pad 116 and palm fluid compartment 115 correspond generally in location and size to palm pad 16 of FIG. 1. Fluid compartments 119 are located between the finger pad 118 and the finger portion 114 of each finger. Each fluid compartment may be gas or liquid filled depending upon the desired feel of the glove. In this embodiment, the compartment 119 is filled with pressurized gas supplied from air bladder 130. Air inflation bladder 130 is connected to a pressure relief valve 128 via tubing 132. Valve 128 also supplies pressurized air to fluid compartment 115, located between palm pad 116 and the palm surface of glove 100, via tubing 126. Valve 128 includes a one-way flow valve to prevent loss of pressure back into the bladder 130 while allowing air to flow from bladder 130 into tubing 126 and 124 when air pressure in the bladder 130 exceeds air pressure in tubes 124 and 126.

Each of the finger pads 118 includes a similar fluid compartment 119 which is in fluid communication with valve 128 via tube 124. Pressurized air is supplied from tube 124 to compartment 119 via fluid passage 117. Fluid passage 117 is of minimal width in relation to the size of compartment 119. Fluid passage 117 may pass around only one side of the finger portion 114 or encircle finger portion 114. Tubing 124 and 126 are sewn or attached to the dorsal side of glove 100 so as to minimize interference with the grip portion (palmar side) of the glove when a hand wearing glove 100 is gripping a bat.

Fluid compartments 115 and 119 are made of rubber, latex, or other suitable material having elastic deformable walls and resilient strength similar to that of a tire inner tube. Fluid compartments 115 and 119 may also include cloth strands incorporated into the walls of the compartments. The cloth strands provide strength and volumetric definition for the compartments after inflation, similar to inflatable catheter balloons. Fluid passages 117 are made of semi-rigid materials and do not expand in size under inflation pressures, as is also the case with tubing 132, 124, and 126.

Air inflation bladder 130 includes an air inlet port (not shown) for drawing air into the bladder. The air inlet port includes a one-way valve for preventing air from escaping the bladder through the inlet port. The one-way valve of the air bladder 130 is typically a rubber flap covering the inlet opening on the inner surface of the bladder 130.

Operationally speaking, the wearer of the glove will physically compress and release bladder 130 several times until the air pressure within compartments 119 and 115 reaches a comfortable and desired air pressure for creating the reminder grip or slot for a proper bat grip. To release the pressure from the compartments 119 and 115, the batter need only depress the pressure relief button 129 incorporated into valve 128. The pressurization of glove 100 is analagous to the pressurization of a sphygmomanometer in that a fluid compartment is pressurized using a compressible air bulb until a desired pressure is achieved.

Figure 9:
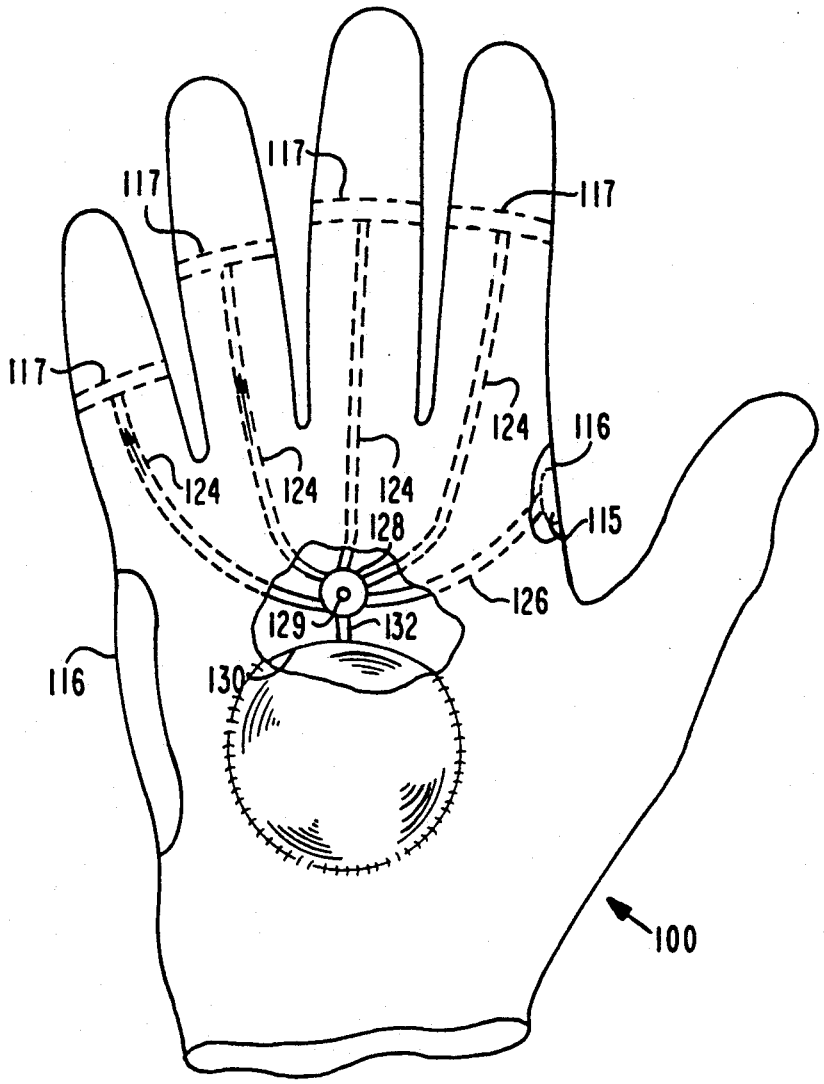
FIG. 9 is a dorsal side view of the batting glove of FIG. 8.

Referring now to FIG. 9, a dorsal side cutaway view of the improved batting glove 100 according to the present invention is shown. Air bladder 130 is sandwiched between two layers of leather on the dorsal side of glove 100. As shown in the cutaway view, air bladder 130 is in fluid communication with pressure relief valve 128 via tubing 132. A check valve is incorporated into pressure relief valve 128 at the connection with tubing 132, thereby preventing backflow of the air from valve 128 into bladder 130. Air supplied from bladder 130 to valve 128 is subsequently supplied through tubing 124 and 126 to fluid passages 117. As the wearer applies physical pressure to bladder 130, thereby pumping air through valve 128 through tubes 124 and fluid passages 117, finger pads 118 of FIG. 8 are inflated to a desired pressure. The palm compartment 115 located between palm pad 116 and the palm portion of glove 100 is also inflated. The fluid compartments 119 and 115 are sewn or glued between pads 118 and 116 in a typical glove as known in the art of batting gloves.

It should be recognized that the air inflation bladder 130, valve 128, tubing 124 and 126, as well as fluid passage 117 are not required if the fluid compartments 119 and 115 are filled with either (a) a predetermined amount of pressurized air, or (b) a gel or liquid. Such an embodiment of the glove 100 is less costly to produce, yet still provides the features of a reminder grip glove via protrusion of the glove 100 in the areas of finger pads 118 and palm pad 116.

In yet another less costly version of glove 100, the air bladder or pump 130 may be removably attached via tubing to the valve 128. Upon reaching a desired pressure and feel, the user disconnects the air pump 130 from valve 128. The fluid compartments will remain pressurized until the pressure release button on valve 128 is depressed.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A batting glove comprising:

a glove having a palmar surface, a dorsal surface, a plurality of finger portions and a thumb portion;

a plurality of finger pads attached to said glove on said palmar surface, said finger pads located only between a first and second phalangeal joint area of each finger portion of said glove;

a palm pad attached to the palmar surface of said glove and extending at least over the metacarpophalangeal joint areas of said palmar surface; and wherein said finger pads and said palm pad define a slot for receiving a bat when said glove is used to grip the bat thereby encouraging a proper grip of the bat.

2. The globe of claim 1 wherein said palm pad extends around the fifth metacarpal bone area to the dorsal surface of said glove.

3. The glove of claim 1 wherein said palm pad tapers from wide to narrow in width across the palmar surface of said glove, said palm pad having a greater width in the area over the fifth metacarpal bone as compared with the width of said palm pad in the area over the second metacarpal bone.

4. The glove of claim 3 wherein said glove, said finger pads and said palm pad are made of tanned animal hides.

5. The glove of claim 3 wherein said glove is made of leather animal hides and said finger pads and said palm pad are made of high-friction means for increasing the coefficient of friction between said pads and the bat when the bat is held within said glove.

6. The glove of claim 3 wherein said glove, palm pad and finger pads are made of synthetic materials.

7. The glove of claim 1 including means for securing the glove snugly about the wrist.

* * * * *

UNITED STATES PATENT AND TRADEMARK OFFICE

CERTIFICATE OF CORRECTION

PATENT NO. : 5,218,719

DATED : June 15, 1993

INVENTOR(S) : Glenn R. Johnson

It is certified that error appears in the above-identified patent and that said Letters Patent is hereby corrected as shown below:

In column 5, at line 26, delete the "," after "butt".

In column 8, at line 44, replace "globe" with --glove--.

Signed and Sealed this

Eleventh Day of January, 1994

Bruce Lehman

*Attest:*

BRUCE LEHMAN

*Attesting Officer*

*Commissioner of Patents and Trademarks*